US006231153B1

(12) United States Patent
Elgee

(10) Patent No.: US 6,231,153 B1
(45) Date of Patent: May 15, 2001

(54) METHOD AND APPARATUS FOR CONTROLLING AN INK-JET PRINT HEAD TEMPERATURE

(75) Inventor: Steven B Elgee, Portland, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 08/845,989

(22) Filed: Apr. 25, 1997

(51) Int. Cl.[7] ..... B41J 29/38; B41J 29/393
(52) U.S. Cl. ..... 347/17; 347/14; 347/19
(58) Field of Search ..... 347/17, 19, 14

(56) References Cited

U.S. PATENT DOCUMENTS

| | | | | |
|---|---|---|---|---|
| 4,704,620 | | 11/1987 | Ichihashi | 346/140 |
| 4,899,180 | | 2/1990 | Elhatem | 346/140 |
| 4,910,528 | | 3/1990 | Firl | 346/1.1 |
| 5,107,276 | | 4/1992 | Kneezel | 346/1.1 |
| 5,109,234 | | 4/1992 | Otis, Jr. | 346/1.1 |
| 5,144,336 | | 9/1992 | Yeung | 346/76 |
| 5,168,284 | | 12/1992 | Yeung | 346/1.1 |
| 5,182,578 | * | 1/1993 | Goepel et al. | 347/17 |
| 5,235,346 | | 8/1993 | Yeung | 346/76 |
| 5,418,558 | | 5/1995 | Hock | 347/14 |
| 5,422,665 | * | 6/1995 | Stephany et al. | 347/17 |
| 5,428,376 | | 6/1995 | Wade | 347/14 |
| 5,475,405 | | 12/1995 | Widder | 347/14 |

* cited by examiner

*Primary Examiner*—John Barlow
*Assistant Examiner*—Charles W. Stewart

(57) ABSTRACT

An ink-jet print head having a dual function thermal controller is disclosed. In a thin-film print head apparatus, a buried resistive layer is located generally circumscribing the other active elements of the print head, viz., the drop generators and the firing logic. During printing operations, the buried resistive layer is used to sense print head temperature. When the print head temperature falls beneath a predetermined minimum limit, the buried resistive layer is activated to act as a heater for the entire print head. Alternatively, the heater can be cycled at predetermined intervals.

9 Claims, 5 Drawing Sheets

METHOD AND APPARATUS FOR CONTROLLING AN INK-JET PRINT HEAD TEMPERATURE

BACKGROUND OF THE INVENTION

1. Field of the Invention

The present invention relates generally to thermal ink-jet printing, more particularly to free-ink ink-jet pens and, more specifically to a dual function thermal control mechanism for ink-jet print heads.

2. Description of Related Art

The art of ink-jet technology is relatively well developed. Commercial products such as computer printers, graphics plotters, copiers, and facsimile machines employ ink-jet technology for producing hard copy. The basics of this technology are disclosed, for example, in various articles in the Hewlett-Packard Journal, Vol. 36, No. 5 (May 1985), Vol. 39, No. 4 (August 1988), Vol. 39, No. 5 (October 1988), Vol. 43, No. 4 (August 1992), Vol. 43, No. 6 (December 1992) and Vol. 45, No. 1 (February 1994) editions. Ink-jet devices are also described by W. J. Lloyd and H. T. Taub in Output Hardcopy Devices, chapter 13 (Ed. R. C. Durbeck and S. Sherr, Academic Press, San Diego, 1988).

In the art, it is known to provide a print head having an orifice plate that operates in combination with subjacent heating elements, such as resistors. Thermal excitation of ink is used to eject droplets through tiny nozzles in the orifice plate onto an adjacent print medium. The combination of a nozzle with an orifice, an ink manifold, and a firing resistor is sometimes referred to simply as a "drop generator" or an "ejector." Generally, the print head is scanned across the print medium and dot matrix manipulation is performed to create a graphics or photographic images or alphanumeric characters from patterns of individual ink droplets at particular locations that can be described as a linear matrix array of picture elements ("pixels").

The ink-jet print head mechanism itself may have a self-contained reservoir (referred to in the art as "on-axis") for storing ink and providing appropriate amounts of ink to the print head during a printing cycle. These self-contained, disposable mechanisms are often referred to as "pint cartridges."

If a refillable type "pen" rather than a print cartridge is employed in the hard copy apparatus, ink is generally supplied from a remote, refillable or replaceable, offboard ("off-axis")ink reservoir which is coupled by an ink conduit to a relatively permanent pen body and print head mechanism. Alternatively, such a "free-ink" ink-jet printing mechanisms have also been designed to have a print head mechanism and a detachable, on-board, reservoir that can be refilled or replaced as needed. The ink-jet pen and particularly the print head element is thus expected to have a longer life than a disposable cartridge.

Early in the development of thermal ink-jet printing it was discovered that the preheating of ink in the vicinity of the ink drop firing resistors has many advantages, as explained for example in U.S. Pat. No. 4,490,728 (Vaught et al., 1984, assigned to the common assignee of the present invention and incorporated herein by reference). The electrical pulse to each resistor comprises a "precursor pulse" and a "nucleation pulse." The precursor pulse preheats the ink in the vicinity of the resistor to a temperature below the boiling temperature of the ink so as to preheat the ink while avoiding vapor bubble nucleation within the local ink supply. Subsequently occurring nucleation pulses very quickly heat the resistor to near the superheat limit of the ink, causing an ink droplet to be ejected through the nozzle. Thus, temperature sensing, or monitoring, of the print head mechanism also became an important operational parameter.

Various means have been invented to accomplish a preheating function in thermal ink-jet print heads. See e.g., U.S. Pat. Nos. 4,704,620; 4,899,180; 4,910,528 (Firl et al., assigned to the common assignee of the present invention); 5,107,276; and, also assigned to the common assignee of the present invention: 5,109,234; 5,144,336; 5,168,284; 5,235,346; 5,418,558 (Firl et al.); 5,428,376; and 5,475,405. Each of these techniques has its advantages and disadvantages.

It has been found, however, that there is a need for a mechanism allowing a preheating of the print head in a solid state fabrication ink-jet print head such that the prior art's complicated and chip area consuming logic are no longer required to accomplish the preheating function.

SUMMARY OF THE INVENTION

In its basic aspects, the present invention provides a thermal ink-jet print head, including: a plurality of drop generators; combinatorial print head driver logic, connected to each of the drop generators, for receiving printing data and driving selected drop generators to fire ink drops based upon the printing data; and a mechanism for thermally controlling temperature of the print head, mounted in relation to both the drop generators and the combinatorial print head driver logic such that the a mechanism for thermally controlling temperature is selectively a passive thermal sensor of average print head temperature and an active heater of the print head when the print head temperature falls below a predetermined minimum operating temperature limit.

The present invention also provides for a thermal ink-jet pen, including: a housing, having an ink accumulation chamber; a print head mounted on the housing; circuitry for connecting the print head to a source of data and power; an ink inlet port for coupling the accumulation chamber to a supply of ink; a regulator coupled to the ink inlet port for controlling both flow of ink into the ink accumulation chamber and gauge pressure at the print head; the print head including a plurality of drop generators, combinatorial driver logic, connected to each of the drop generators, for receiving printing data and selectively driving drop generators based upon the printing data, and mechanisms for thermally controlling temperature of the print head, mounted adjacent both the drop generators and the combinatorial driver logic, wherein the mechanisms for thermally controlling temperature is selectively a passive thermal sensor of average print head temperature and an active heater of the print head when the print head temperature falls below minimum temperature limit.

The present invention also provides for a method for controlling temperature of a thermal ink-jet print head, the method including the steps of providing a temperature controller device including a resistor element substantially encompassing the print head; using the resistor element as a passive device, measuring temperature of the print head and transmitting a signal indicative of average print head temperature; when the signal indicative of average print head temperature falls below a predetermined minimum temperature for operation of the print head, using the temperature controller device to activate the resistor element as an active device to heat the print head to a predetermined operational temperature.

The present invention also provides a thermal ink-jet print head, including: a plurality of drop generators; combinatorial print head driver logic, connected to each of the drop generators, for receiving printing data and driving selected drop generators to fire ink drops based upon the printing data; and a thermally control temperature of the print head, including an integrally mounted print head resistor, mounted in relation to both the drop generators and the combinatorial print head driver logic such that the print head resistor is selectively a passive thermal sensor of average print head temperature and an active heater of the print head when the print head temperature falls below a predetermined minimum operating temperature limit and a reference resistor connected to the print head resistor.

It is an advantage of the present invention that it eliminates the necessity of complex preheating algorithms for ink-jet pen drop generators.

It is another advantage of the present invention that it provides for a simple solid state fabrication of an ink-jet pen print head mechanism.

It is a further advantage of the present invention that it provides dual functionality to a print head sensing element.

It is still another advantage of the present invention that an ink-jet print head is heated with constant low power rather than short high power pulses, lengthening product life.

It is yet another advantage of the present invention that heating of a print head is provided by separate mechanisms other than an ink drop firing resistor, lengthening product life.

Other objects, features and advantages of the present invention will become apparent upon consideration of the following explanation and the accompanying drawings, in which like reference designations represent like features throughout the drawings.

The drawings referred to in this specification should be understood as not being drawn to scale except if specifically noted.

DESCRIPTION OF THE PREFERRED EMBODIMENT

Reference is made now in detail to a specific embodiment of the present invention, which illustrates the best mode presently contemplated by the inventors for practicing the invention. Alternative embodiments are also briefly described as applicable.

Figure 1:
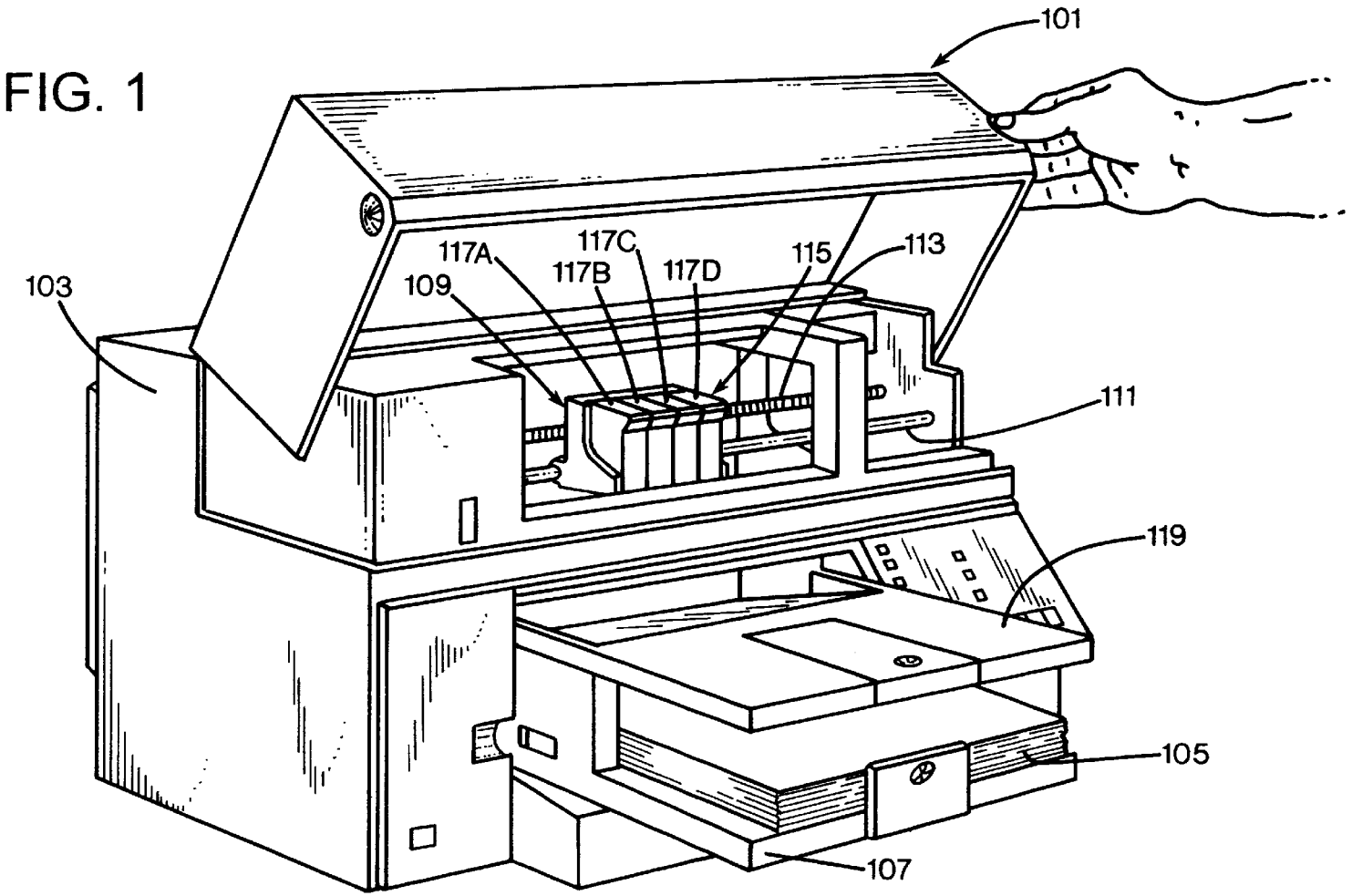
FIG. 1 is a perspective view, schematic drawing of an ink-jet hard copy apparatus incorporating the present invention.

FIG. 1 shows an ink-jet hard copy apparatus; in this exemplary embodiment, it depicts a computer peripheral printer 101. A housing 103 encloses the electrical and mechanical operating mechanisms of the printer 101. Operation is administrated by an electronic controller (usually a microprocessor-controlled, printed circuit board, FIG. 3, element 311; such controllers 311 are known in the art and typically also provide other functions for the hard copy apparatus in which they are employed, such as control of the print head carriage (FIG. 1, 109), movement of a print media through the printer 101, and the like), connected by appropriate cabling to a computer (not shown). Cut-sheet print media 105, loaded by the end-user onto an input tray 107, is fed by an internal paper-path transport mechanism (not shown; e.g., a motor and paper driver rollers) to an internal printing station where images or alphanumeric text are printed. A carriage 109, mounted on a slider 111, scans the print medium. An encoder 113 is provided for keeping track of the position of the carriage 109 at any given time and feeding back positional information to the controller 311. A set 115 of ink-jet pens (or print cartridges) 117A–117D are releasable mounted in the carriage 109 for easy access. In pen-type hard copy apparatus, separate, replaceable or refillable, ink reservoirs (not shown; relatively large volume—with respect to pen size—disposable, ink cartridges) are located within the housing 103 and appropriately coupled to the pen set 115 via ink conduits (not shown). Once a printed page is completed, the print medium 105 is ejected onto an output tray 119.

Figure 2:
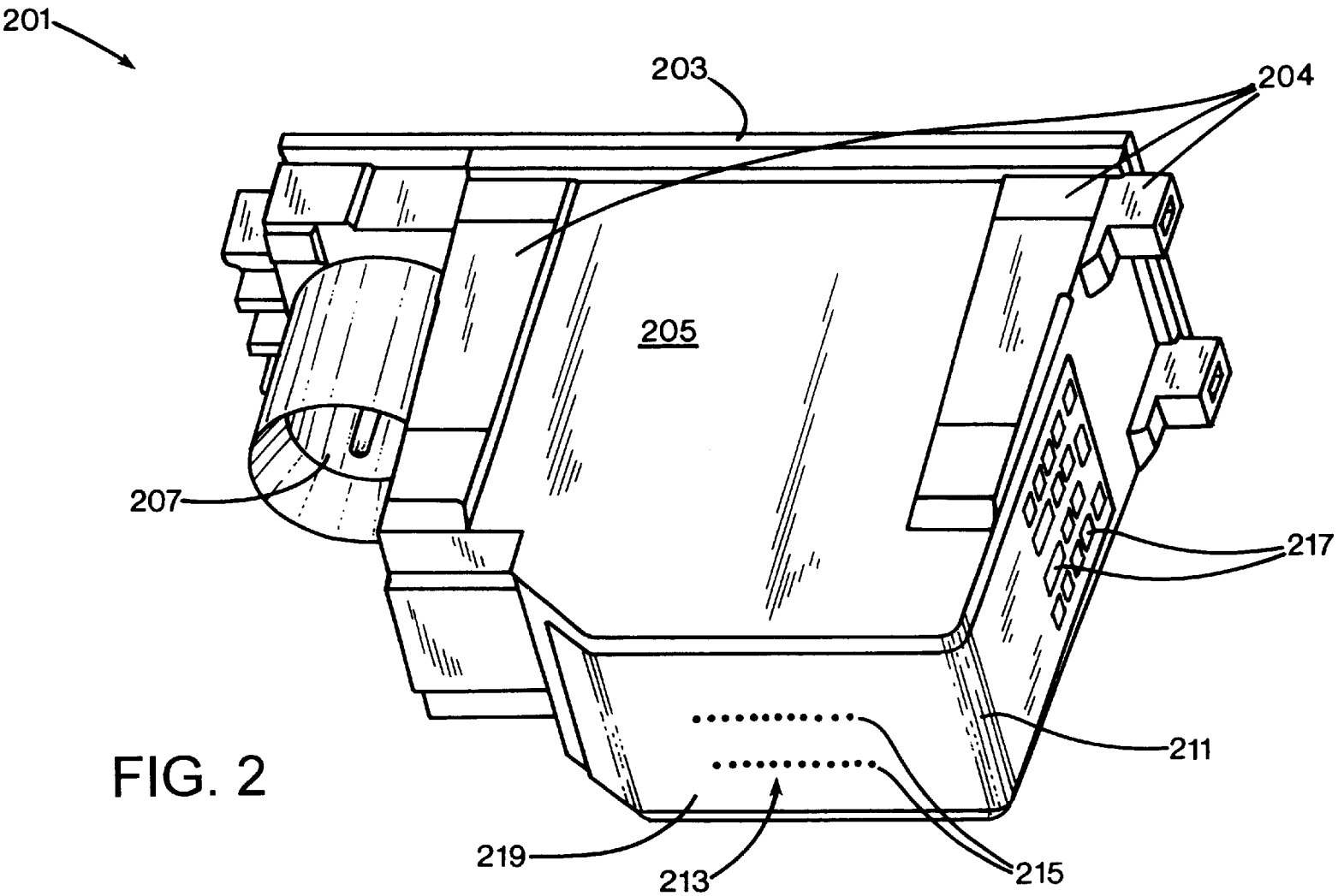
FIG. 2 is a perspective view, schematic drawing of an ink-jet pen in accordance with the present invention.

FIG. 2 shows an exemplary ink-jet pen 201. A shell, or housing, 203 includes appropriate bosses and datums 204 for mounting the pen 201 in the carriage 109 (FIG. 1). The cartridge housing 203 also contains an internal, ink accumulation chamber, or accumulator, 205. Ink from the ink reservoir is supplied to the accumulation chamber 205 via a suitable ink conduit coupled to a mechanism mounted on and through the cartridge housing 203 as an ink inlet port 207. A pressure regulator (not shown) is mounted within the accumulation chamber 205 for regulating the flow of ink from the reservoir to a print head 219 and for maintaining the appropriate print head back pressure (gauge pressure relative to ambient atmospheric pressure). In the state of the art, it is known that the print head 219, having an array 213 of orifices 215 (and respective subjacent nozzles and a manifold that fluidically couple the print head 219 to the ink accumulator chamber 205 can be fabricated as a thin-film device (that is fabricated integrated circuit techniques; see FIG. 5, infra). The print head 219 can be fabricated as part of a flexible circuit 211 (e.g., tape automated bonding, TAB) that wraps about appropriate faces of the pen cartridge housing 203 such that the print head 219 will be appropriately positioned as the pen 201 is scanned across a print media. For printing data signals and power, the flexible circuit 211 provides electrical contacts 217 for interconnecting the on-board, print head driver logic (FIG. 3, element 313) to the printer controller 311.

With ink supplied from an off-board, replaceable or refillable reservoir, it is intended that the pen 201 have an extended life; that is, a much larger throughput volume of ink will be used in conjunction with the free-ink pen 201 than would be with a unitary, disposable, print cartridge having a self-contained ink reservoir.

Figure 3:
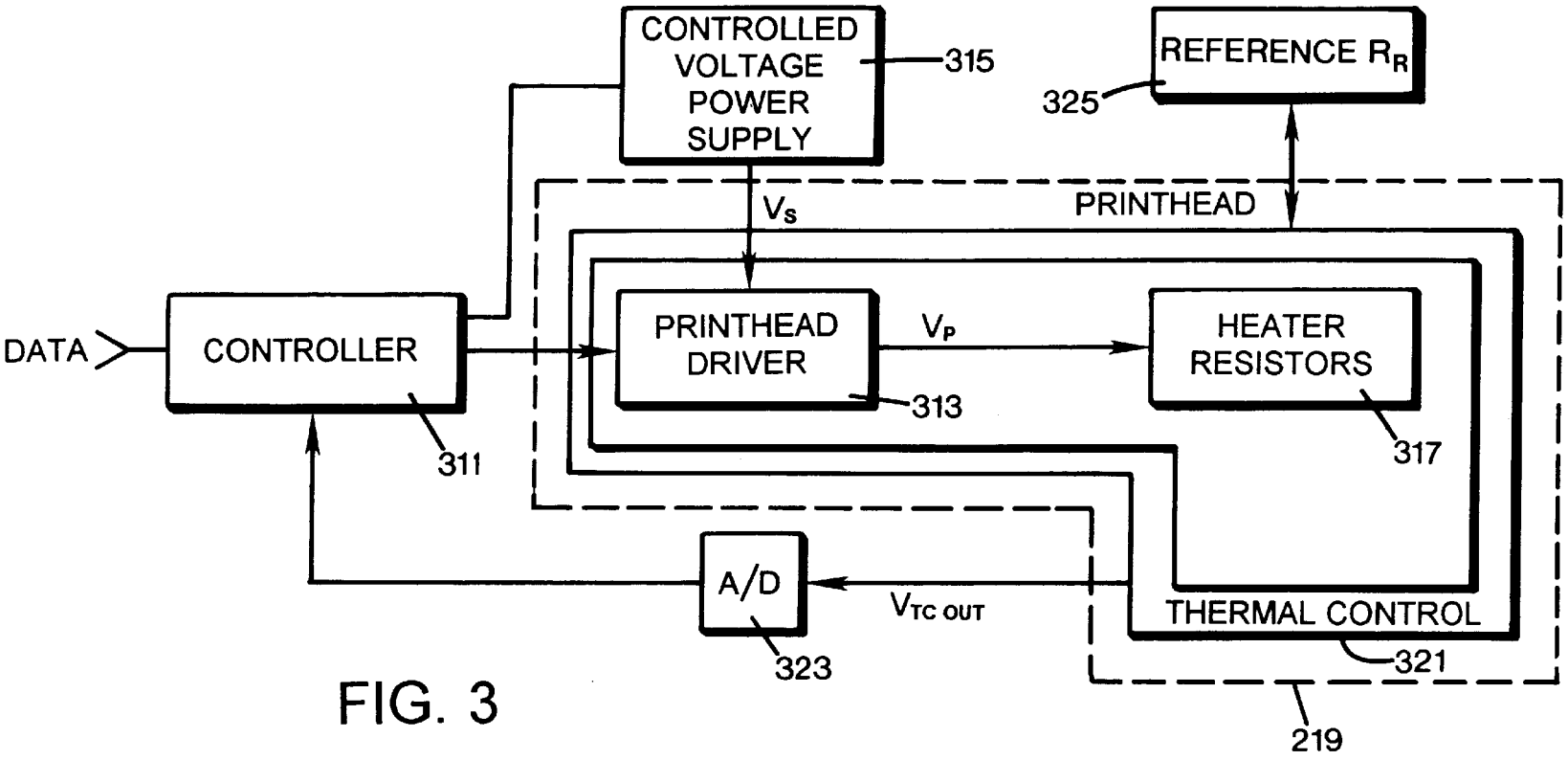
FIG. 3 is a block diagram of the electronic circuitry for an ink-jet hard copy apparatus as shown in FIG. 1.

FIG. 3 depicts a simplified block diagram of the electronics of a thermal ink-jet printer that employs the print head 219 thermal control techniques of the invention. In addition to other hard copy apparatus functions, a controller 311 receives print data input (usually supplied by a computer to the controller; e.g., a graphical image on a video display to be printed) and processes the print data to provide print control information to the print head driver circuitry 313. The print head driver circuitry 313 in the present invention is simple combinatorial logic for multiplexing the drop generators to the input data. A controlled voltage power supply 315 provides the print head driver circuit 313 with a controlled supply voltage, $V_S$ whose magnitude is controlled by the controller 311. The print head driver circuit 313, as controlled by the controller 311, applies driving voltage pulses, $V_P$ (also referred to as energizing or firing pulses) to a thin-film ink-jet print head 219 that includes ink drop firing ink drop firing resistors 317. Since the actual voltage across a heater resistor cannot be readily measured, turn-on energy for a heater resistor 317 will be with reference to the voltage applied to the contact pads of the print head associated with the heater resistor. The resistance associated with a heater resistor 317 will be expressed in terms of pad-to-pad resistance of a heater resistor 317 and it's interconnect circuitry (the resistance between the print head contact pads associated with a specific heater resistor). The relationship between the pulse voltage $V_P$ and the supply voltage $V_S$ will depend on the characteristics of the driver circuitry. For example, the print head driver 313 can be modeled as a substantially constant voltage drop $V_D$, and for such implementations the pulse voltage $V_P$ is substantially equal to the supply voltage $V_S$ reduced by the voltage drop $V_D$ of the driver circuit:

$$V_P=V_S-V_D \quad \text{(Equation 1).}$$

If the print head driver 313 is better modeled as having a resistance $R_D$, then the pulse voltage $V_P$ is expressed as:

$$V_P=V_S(R_P/(R_D+R_P)) \quad \text{(Equation 2),}$$

where $R_P$ is the pad-to-pad resistance associated with a heater resistor 317.

The controller 311 provides pulse width and pulse frequency parameters to the print head driver circuitry 313 which then produces appropriate drive voltage pulses $V_P$ multiplexed to specific ink drop firing resistors 317 in accordance with input data. In accordance with the present invention, separate preheating and nucleation pulses are not needed. Thus, the print head driver 313 (FIGS. 3 and 4) can be a simplified combinatorial logic; that is, logic that based on the DATA input shifted in merely needs to provide a FIRE pulse or NOT FIRE switching function to the ink drop firing resistors 317. Note again that all of the extra drivers and control circuits required by the prior art—such as for an integrated, disposable, print cartridge—for precursor pulse warming is eliminated.

Figure 4:
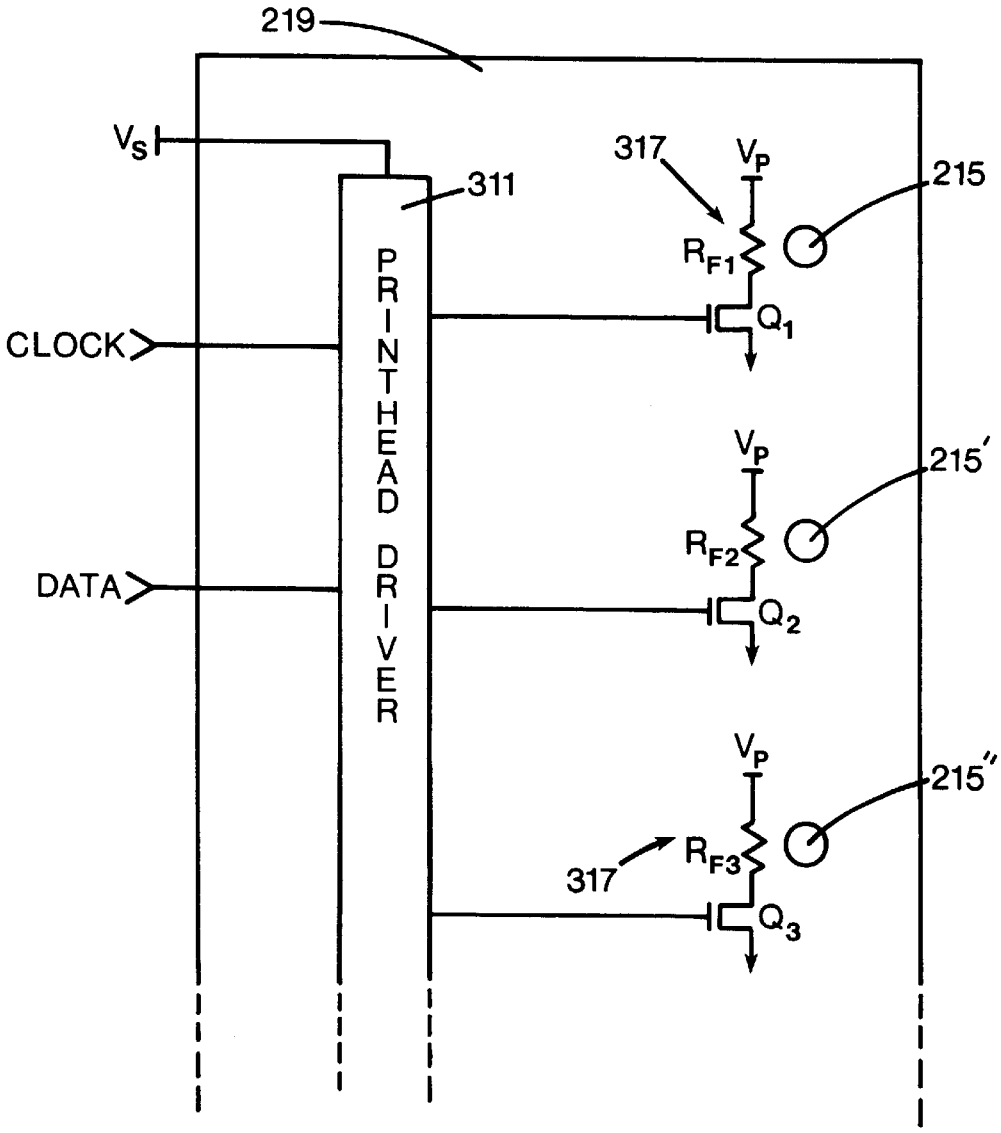
FIG. 4 is a circuit diagram for the print head of the ink-jet pen shown in FIG. 2.

A rudimentary electromechanical schematic of the print head 219 in accordance with the present invention is shown in FIG. 4. It should be understood that the print head 219 is fabricated using integrated circuit techniques and that in the practical state of the art, hundreds of components are incorporated into the print head. Each of the nozzle orifices 215, 215', 215" has a respective, subjacent, thin-film, firing resistor $R_{F1}$, $R_{F2}$, $RF_3$ which can be selectively turned on and off by related respective transistors $Q_1$, $Q_2$, and $Q_3$ based upon the output of the control logic 301. Again, as taught by Vaught et al. and Firl et al., supra, thermal control is known to be provided in the art by sending precursor, or preheating, pulse to each of the firing resistors $R_{F1}$–$R_{FN}$ individually; this naturally requires extra onboard logic and control, expensive and complex hardware (resistors not actually firing need to be preheated for the next data cycle). Moreover, since the pen 201 is to have an extended life, the use of such precursor pulse warming is impractical since it shortens the life of firing resistors. Thermal control is determined by adding a separate thermal sensor (e.g., as taught by Hock et al., supra) for sampling print head temperature.

Figure 5:
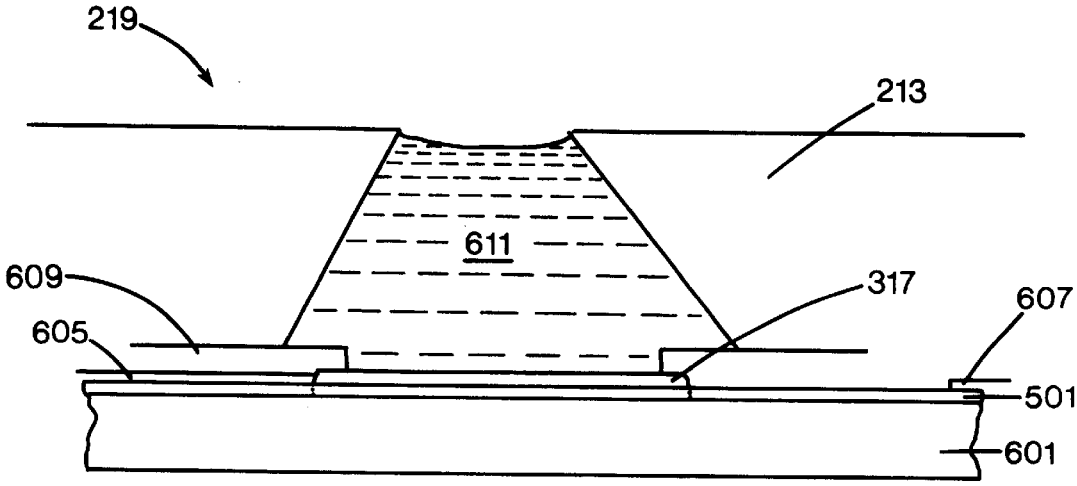
FIG. 5 is a cross-sectional depiction of a drop generator of a thin-film constructed print head of a ink-jet pen as shown in FIG. 2.

The print head 219 of the present invention can be fabricated using known thin-film construction technology (analogous to the manufacture of integrated circuits) and structured as shown in FIG. 5. A silicon substrate 601 forms a base, or platform, for the electrical circuitry and orifice plate, i.e., the drop generator constructs. In the same metallization layer in which firing resistors 317, $R_{F1}$–$R_{FN}$, are formed, a single, thin-film, metal layer 501, comprising the thermal controller 321, is formed as a metallization layer circumnavigating the print head 219. Both the firing resistors 317 and the metal layer 501 are provided with electrical leads 605, 607, respectively. An ink manifold 609 is formed to bring ink 611 from the accumulator 205 (FIG. 2) into each drop generator. The nozzle plate 213 itself completes the structure. The thermal controller 321, including metal layer 501, has a dual function: a print head temperature sensor and a resistive, print head heater.

Figure 6:
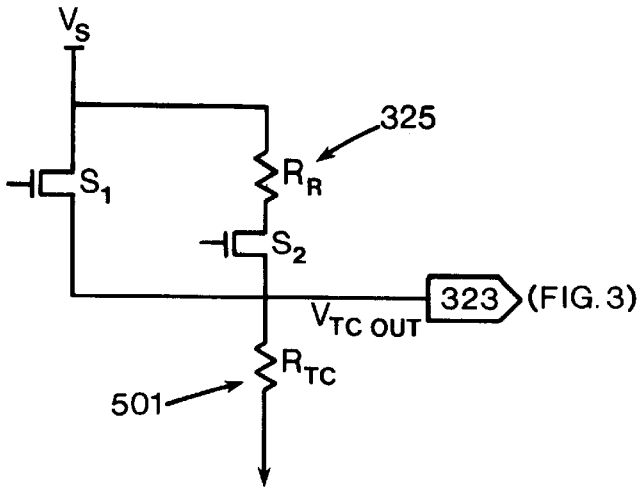
FIG. 6 is an electrical equivalent circuit drawing for the thermal control mechanism of the present invention as shown in FIG. 3.

The electrical equivalent circuit describing the operation of the dual function resistor 501 is demonstrated in FIG. 6. The thermal controller thin-film resistor 501 has a known nominal resistance at a given temperature, e.g. $R_{25C}$. Resistance is always given in terms of a tolerance, e.g. ±15%, and a temperature coefficient, e.g. ±0.35%° C. Thus, during operation, true resistance of the thermal controller 321 is:

$$R_{TC}=R_{25C}+0.0035\ (T-25) \quad \text{(Equation 3).}$$

The mechanism for thermally controlling temperature further includes a reference resistor $R_R$ connected to the metal layer 501, forming a voltage divider therewith such that a voltage tapped between an externally mounted, precision, reference resistor $R_R$ 325 (FIGS. 3 and 6) and the resistor 501 element is indicative of the average temperature of the print head. The resistance of the reference resistor, $R_R$, is known. Therefore, the output of the thermal controller 321 in the active mode is:

$$V_{TCout}=R_{TC}(V_S)/(R_R+R_{TC}) \quad \text{(Equation 4)}$$

when transistor $S_2$ is ON and transistor $S_1$ is OFF. Periodically sampling $V_{TCout}$—e.g., every five milliseconds—is therefore an equivalent to determining the average print head temperature. A predetermined lower limit operating temperature can be compared and, when $V_{TCout}$ indicates that the print head temperature is below the lower limit tolerance, switching transistor $S_1$ can be turned on and power applied to the resistor $R_{TC}$ 501. Power can be applied either for a predetermined fixed time period or until $V_{TCout}$ is raised to a predetermined voltage equivalent to the proper print head operating temperature. A sampling period is determined experimentally for each print head design; sampling too often would waste controller bandwidth and too infrequently would lead to undesirable print head temperature excursions. Thus, the temperature controller 321 can be operated by periodic sampling, cyclic activation, or by comparison to set temperature thresholds or a range of temperatures, and using the temperature controller accordingly based upon a comparison match criteria.

Referring back to FIG. 3, the analog output of the thermal controller 321 is sent to an analog-to-digital (A/D) converter 323 which provides a corresponding digital signal to the controller 311. In the passive mode of operation, the digital output of the A/D converter 323 comprises quantized samples of the analog output of the thermal controller 321 acting in its passive temperature sensor mode. Therefore, the output of the AND converter 323 is indicative of the temperature of the print head 219 as detected by the thermal controller 321. When the detected temperature falls beneath a predetermined operating temperature, e.g., twenty-five degrees Centigrade, 25° C., the controller will turn on the thermal controller 321 such that it acts as an active print head heater.

Thus the present invention provides a thermal ink-jet pen with a print head having an on-board thermal controller having substantial advantages over the prior art. The foregoing description of the preferred embodiment of the present invention has been presented for purposes of illustration and description. It is not intended to be exhaustive or to limit the invention to the precise form disclosed. Obviously, many modifications and variations will be apparent to practitioners skilled in this art. Similarly, any process steps described might be interchangeable with other steps in order to achieve the same result The embodiment was chosen and described in order to best explain the principles of the invention and its best mode practical application to thereby enable others skilled in the art to understand the invention for various embodiments and with various modifications as are suited to the particular use contemplated. It is intended that the scope of the invention be defined by the claims appended hereto and their equivalents.

What is claimed is:

1. A thermal ink-jet print head, comprising:

a thin-film construct including a plurality of drop generators, combinatorial print head driver logic, connected to each of the drop generators, for receiving printing data and driving selected drop generators to fire ink drops based upon said printing data, and means for thermally controlling temperature of said print head, mounted in relation to both said drop generators and said combinatorial print head driver logic such that said means for thermally controlling temperature is selectively a passive thermal sensor of average print head temperature and an active heater of said print head when said print head temperature falls below a predetermined minimum operating temperature limit said means for thermally controlling temperature further including a metal layer, forming resistor element having a shape and areal dimensions such that said resistor element substantially circumscribes said print head.

2. The thermal ink-jet print head as set forth in claim 1, said means for thermally controlling temperature further comprising:

a reference resistor connected to said metal layer, forming a voltage divider therewith such that a voltage tapped between said reference resistor and said resistor element is indicative of average temperature of said print head.

3. The thermal-ink-jet print head as set forth in claim 1, said means for thermally controlling temperature further comprising:

a resistive element; and circuit means for receiving a signal indicative of temperature of said print head and for applying power to said resistive element to heat said print head to a predetermined operating temperature.

4. A thermal ink-jet pen, comprising:

a housing, having an ink accumulation chamber;

a print head mounted on said housing;

circuitry connecting said print head to a source of data and power;

an ink inlet port for coupling said accumulation chamber to a supply of ink;

a regulator coupled to said ink inlet port for controlling both flow of ink into said ink accumulation chamber and gauge pressure at said print head;

a thin-film print head device including a plurality of drop generators, combinatorial driver logic, connected to each of said drop generators, for receiving printing data and selectively driving drop generators based upon said printing data, and a means for thermally controlling temperature of said print head, mounted adjacent both said drop generators and said combinatorial driver logic, wherein said means for thermally controlling temperature is selectively a passive thermal sensor of average print head temperature and an active heater of said print head when said print head temperature falls below minimum, temperature limit, including a resistor formed as a part of a metallization layer in the print head device having a shape and areal dimenstion such that said resistor element substantially circumscribes the print head device and such that said resistor is acting as a sensor of temperature.

5. The pen as set forth in claim 4, said means for thermally controlling temperature further comprising:

a reference resistor connected to said metal layer, forming a voltage divider therewith such that a voltage tapped between said reference resistor and said resistor element is indicative of average temperature of said print head.

6. The pen as set forth in claim 5, said means for thermally controlling temperature further comprising:

an externally mounted, precision, reference resistor connected to said resistor, forming a voltage divider therewith such that a voltage tapped between said reference resistor and said resistor is indicative of average temperature of said print head.

7. The pen as set forth in claim 6, said means for thermally controlling temperature further comprising:

means for switching said resistor from a passive state as a thermal sensor to an active state as a heater when said average temperature of said print head falls below a predetermined operating temperature.

8. A thermal ink-jet print head, comprising:

a plurality of drop generators;

combinatorial print head driver logic, connected to each of said drop generators, for receiving printing data and driving selected drop generators to fire ink drops based upon said printing data; and a thermal control for temperature of said print head, including an integrally mounted print head resistor, mounted in relation to both said drop generators and said combinatorial print head driver logic such that said print head resistor is selectively a passive thermal sensor of average print head temperature and an active heater of said print head when said print head temperature falls below a predetermined minimum operating temperature limit and a reference resistor connected to said print head resistor wherein said print head is a thin-film fabricated construct having a metallization layer including a plurality of firing resistors, and said print head resistor is formed in said metallization layer, forming a resistor element having a shape and areal dimensions such that said resistor element substantially circumscribes at least said firing resistors.

9. The thermal ink-jet print head as set forth in claim 8, said reference resistor further comprising:

a precision resistor connected to said metal layer, forming a voltage divider therewith such that a voltage tapped between said reference resistor and said print head resistor is indicative of average temperature of said print head.

* * * * *

UNITED STATES PATENT AND TRADEMARK OFFICE

CERTIFICATE OF CORRECTION

PATENT NO. : 6,231,153 B1
DATED : May 15, 2001
INVENTOR(S) : Elgee

It is certified that error appears in the above-identified patent and that said Letters Patent is hereby corrected as shown below:

Column 7,
Line 38, after "forming", insert -- a --.

Signed and Sealed this

Sixth Day of May, 2003

JAMES E. ROGAN
*Director of the United States Patent and Trademark Office*